United States Patent [19]

Bock

[11] Patent Number: 5,024,136

[45] Date of Patent: Jun. 18, 1991

[54] EQUIPMENT FOR GUN LOADER

[75] Inventor: Erich Bock, Nuremberg, Fed. Rep. of Germany

[73] Assignee: DIEHL GmbH & Co., Nuremberg, Fed. Rep. of Germany

[21] Appl. No.: 497,359

[22] Filed: Mar. 22, 1990

[30] Foreign Application Priority Data

Apr. 14, 1989 [DE] Fed. Rep. of Germany ..... 3912287

[51] Int. Cl.[5] ..... F42C 17/04

[52] U.S. Cl. ..... 89/6; 89/6.5

[58] Field of Search ..... 89/6, 6.5

[56] References Cited

U.S. PATENT DOCUMENTS

| | | | |
|---|---|---|---|
| 3,371,579 | 3/1968 | Kinzelman | 89/6 |
| 3,777,665 | 12/1973 | Ziemba | 89/6 |
| 4,022,102 | 5/1977 | Ettel | 89/6.5 |
| 4,283,989 | 8/1981 | Toulios et al. | 89/6.5 |
| 4,327,625 | 5/1982 | Beuchat et al. | 89/6 |

*Primary Examiner*—David H. Brown

*Attorney, Agent, or Firm*—Scully, Scott, Murphy & Presser

[57] ABSTRACT

Equipment for a gun loader, which incorporates a coil connected through the intermediary of a wire to a plotting apparatus, and through the utilization of which it is possible to set the fuze of an article of ammunition from the equipment of a gun layer or aimer. Inventively, the above-mentioned object is readily attained in that the coil is fastened at such a first location on an equipment which is worn by the gun loader, with which the ammunition fuze comes into contact during the handling of the ammunition during the loading sequence; in that the plotting apparatus is fastened at such a second location on the equipment which is easily viewable by the gun loader; and that between the plotting apparatus and the equipment worn by the gun layer there is provided either a wire-connected or wireless signal transmitting path.

13 Claims, 1 Drawing Sheet

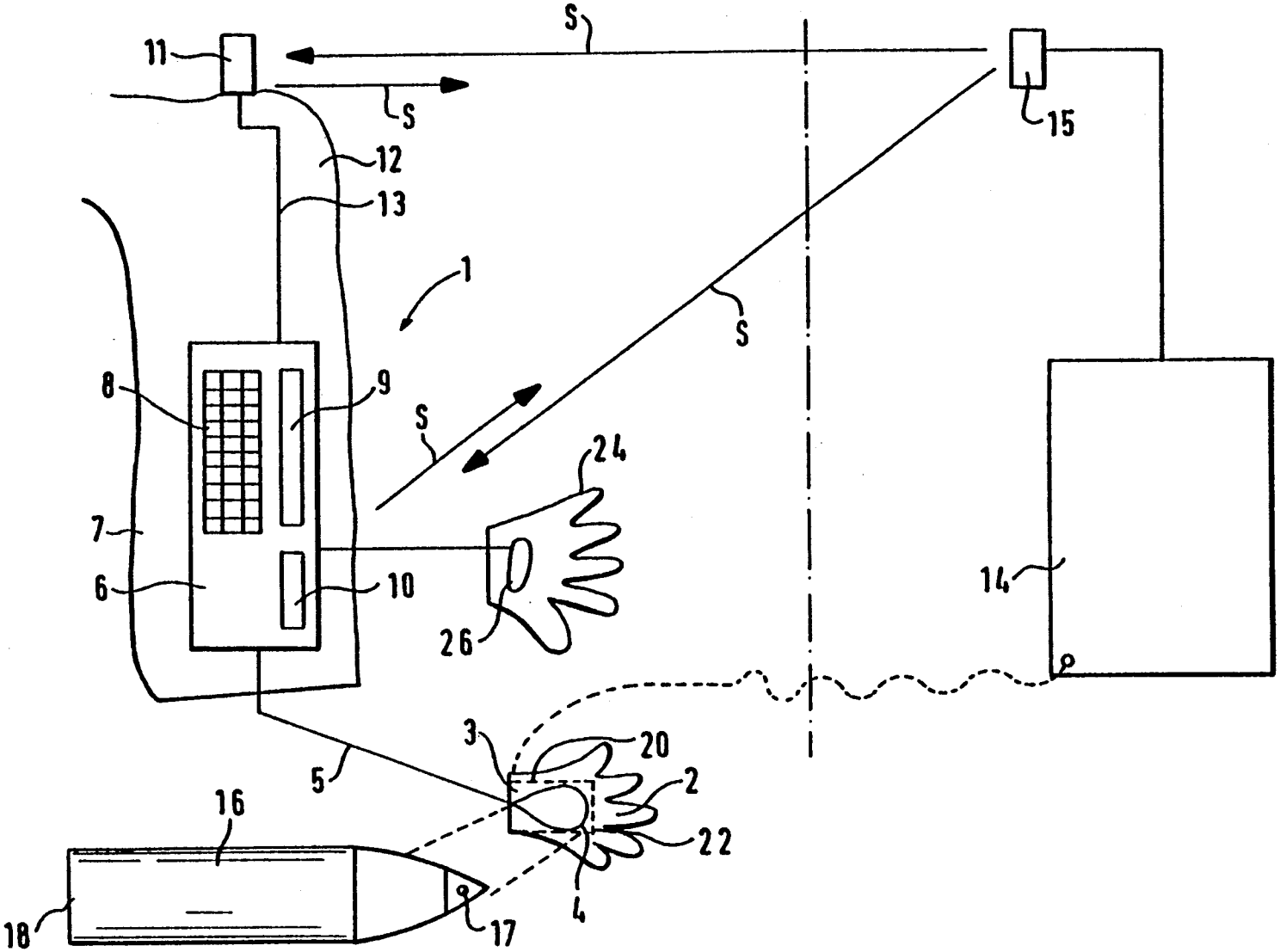
15
14
S
S
S
S
24
26
1
12
13
9
10
11
8
7
6
5
3
20
2
22
4
17
16
18

EQUIPMENT FOR GUN LOADER

BACKGROUND OF THE INVENTION

1. Field of the Invention

The present invention relates to equipment for a gun loader, which incorporates a coil connected through the intermediary of a wire to a plotting apparatus, and through the utilization of which it is possible to set the fuze of an article of ammunition from the equipment of a gun layer or aimer.

2. Field of the Invention

Pursuant to the current state-of-the-art, the coil as described hereinbefore is provided with a handgrip. The coil is to be positioned by the gun loader, for example, of a battle tank, coaxially onto the fuze for the setting of the latter. A switch is integrated into the handgrip, through the intermediary of which there is initiated the programming (setting). Two indicator lamps are provided on the handgrip so as to be able to control the programming. In order to be able to position the coil on the ammunition fuze through the use of the handgrip, the gun loader must have one hand free. This renders the setting cumbersome and time-consuming during the loading . sequence.

SUMMARY OF THE INVENTION

Accordingly, it is an object of the present invention to improve upon equipment of the above-mentioned type for a gun loader in such a manner that, during the loading sequence which is carried out by the gun loader, the data transmission between the ammunition and the equipment of the gun layer or aimer becomes simple in nature for the gun loader and is rapidly implemented.

Inventively, the above-mentioned object is readily attained in that the coil is fastened at such a first location on an equipment which is worn by the gun loader, with which the ammunition fuze comes into contact during the handling of the ammunition during the loading sequence; in that the plotting apparatus is fastened at such a second location on the equipment which is easily viewable by the gun loader; and that between the plotting apparatus and the equipment worn by the gun layer there is provided either a wire-connected or wireless signal transmitting path.

During the transport of the ammunition by the gun loader, the coil comes into contact with the ammunition fuze without the need for any additional manipulation. During this contacting there is carried the setting of the ammunition fuze. The gun loader can control the setting on the plotting apparatus. Consequently, the gun loader does not need to manipulate the coil as a separate component for effectuating the fuze setting. Thus, in particular, he does not have to free a hand in order to bring the coil into contact with the ammunition fuze. This simplifies the activity of the gun loader and speeds up the loading sequence.

The coil can be arranged at any suitable location on the equipment, which positively comes into contact with the ammunition fuze during the loading sequence. Preferably, the coil is arranged on a glove of the equipment which is worn by the gun loader.

The plotting apparatus, pursuant to a particular embodiment of the invention, is fastened to one of the lower arms of the equipment worn by the gun loader. As a result thereof, even during the manipulating of the ammunition, it is easily viewable during the loading sequence. Preferably, the plotting apparatus is arranged on the left lower arm. In view thereof, it can then be operated by means of the right hand.

Pursuant to a further embodiment of the invention, the wireless signal transmitting path operates with an infrared receiver-transmitter which is connected with the plotting apparatus, and with an infrared transmitter-receiver which is connected with the equipment for the gun layer or aimer. In order to improve upon the signal transmission, the infrared receiver-transmitter which is connected with the plotting apparatus is preferably mounted on one of the shoulders of the equipment which is worn by the gun loader.

Accordingly to a further feature of the invention, a temperature sensor is fastened at such a third location on the equipment worn by the gun loader, which can be brought into contact with the casing for the propellent charge of the ammunition; for instance, coming into contact with the casing for the propellent charge of the ammunition during the handling of the latter. The temperature sensor is connected to the plotting apparatus. Thus, by means of the temperature sensor, there is approximatingly determined the current temperature for the powder of the propellent charge, which exerts a significant influence over the firing velocity for the projectile. The temperature information is transmitted to the equipment of the gun layer and is considered therein as a corrective value.

Preferably, the temperature sensor is also fastened to a glove of the equipment. Already prior to the loading sequence, as long as the ammunition is still located in a support, it is possible for the gun loader at periodic intervals, through contacting the ammunition to be able to transmit the temperature to the equipment of the gun layer or aimer, such that already preceding the loading sequence can there be processed the actual temperature of the propellent charge by the equipment of the gun layer. However, it would also be adequate to only first determine the temperature upon handling of the ammunition during the loading sequence. The temperature sensor is then preferably arranged on the other glove than that containing the coil.

BRIEF DESCRIPTION OF THE DRAWING

Further advantageous embodiments and features of the invention can now be readily ascertained from the following detailed description of an exemplary embodiment thereof, taken in conjunction with the accompanying single figure of the drawing schematically illustrating equipment worn by a gun loader, and showing the ammunition and associated equipment of a gun layer or aimer.

DETAILED DESCRIPTION

An equipment 1 worn by a gun loader possesses a glove 2. Fastened to the inner surface 3 of the glove is a coil 4. The axis of the coil 4 extends generally perpendicular to the inner surface 3 of the glove. The coil 4 can be inserted into a pocket 20 formed in the glove 2. It can also be sewn into a fabric component which is attached to the inner surface 3 of the glove by means of a zipper fastener 22 so as to form the pocket.

The coil 4 is connected through a wire or cable 5 to a plotting apparatus 6. The latter is fastened to a lower arm 7 on the equipment 1. The plotting apparatus 6 includes a control panel 8, a display field 9 and an infrared receiver-transmitter 10. In addition to, or instead of this transmitter-receiver 10, an infrared receiver-transmitter 11 is mounted on one shoulder 12 of the equipment 1 and is connected through a wire or cable 13 with the plotting apparatus 6.

An infrared transmitter-receiver 15 is connected to equipment 14 for a gun layer.

An article of ammunition 16 incorporates an ammunition fuze 17 and a casing 18 for a propellent charge.

The function of the above-described arrangement is generally somewhat as follows:

The equipment 14 of the gun layer, through the intermediary of the transmitter-receiver 15, transmits the data which are necessary for the setting of the fuze 17 over the infrared signal transmitting path S. These data are received by the transmitter-receiver 10 or, respectively 11 and evaluated in the plotting apparatus 6, and then conducted along the coil 4 as well as, when required, indicated on the display field 9. During the handling of the ammunition 16 the gun loader of a battle tank, through the use of the glove 2, holds the ammunition 16 against the ammunition fuze 17. As a result thereof, the fuze 17 is set by the coil 4. Upon the completion of the setting, this information is indicated on the display field 9. Moreover, a corresponding confirmation signal conducted by means of the receiver-transmitter 10, or respectively 11, over the infrared signal transmitting path S to the transmitter-receiver 15, whereby this will then confirm for the gun layer of the battle tank that the setting of the fuze has been completed. Through operation of the control panel 8, the gun loader of the battle tank is able, if necessary, to manually undertake the setting of the fuze.

Arranged on the other glove 24 of the equipment 1, can be a temperature sensor 26 which is connected to the plotting apparatus 6. When the gun loader during handling of the ammunition 16, contacts the casing 18 for the propellent charge with this glove, then the temperature thereof is obtained, and by means of the receiver-transmitter 10 or 11 is conducted over the infrared signal transmitting path S to the equipment 14 of the gun layer. In that equipment there is then known approximatingly the temperature of the propellent charge, and can then be considered for further computations; for example, with regard to the setting or aiming of the weapon barrel.

It is also possible that instead of the infrared signal transmitting path S being present between the receiver-transmitter 10 or 11 and the transmitter-receiver 15, there is provided a wire or cable which connects the plotting apparatus 6 with the equipment 14 of the gun layer.

What is claimed is:

1. Equipment for a gun loader; comprising a coil which is wire-connected to a plotting apparatus through which there can be set the fuze of an article of ammunition from the equipment of a gun layer during the loading sequence of the ammunition, said coil being fastened to a first location on equipment worn by a gun loader and in which the ammunition fuze comes into contact with said location during the loading sequence, said plotting apparatus being fastened to the equipment at a second location which is readily viewable by the gun loader, and wherein a signal transmitting path is formed between the plotting apparatus and the equipment of the gun layer.

2. Equipment as claimed in claim 1, wherein said signal transmitting path is wire-connected.

3. Equipment as claimed in claim 1, wherein said signal transmitting path is wireless.

4. Equipment as claimed in claim 1, wherein said coil is arranged on a glove of the equipment for the gun loader.

5. Equipment as claimed in claim 4, wherein the coil is arranged on the inner surface of the glove.

6. Equipment as claimed in claim 1, wherein the coil is inserted into a pocket formed in the equipment.

7. Equipment as claimed in claim 3, wherein the coil is sewen into a fabric component which is fastened to the equipment by a zipper closure.

8. Equipment as claimed in claim 1, wherein the plotting apparatus is fastened to a lower arm of the equipment worn by the gun loader.

9. Equipment as claimed in claim 1, wherein one shoulder on the equipment worn by the gun loader mounts an infrared receiver-transmitter which is connected with the plotting apparatus and is operatively associated with an infrared transmitter-receiver of the equipment for the gun layer.

10. Equipment as claimed in claim 1, wherein a temperature sensor is fastened at a third location to the equipment worn by the gun loader so as to be brought into contact with a casing of a propellent charge for the ammunition, and the temperature sensor is connected with the plotting apparatus.

11. Equipment as claimed in claim 10, wherein the temperature sensor is fastened at such a third location on the equipment which comes into contact with a casing for the propellent charge during the handling of the ammunition.

12. Equipment as claimed in claim 11, wherein the temperature sensor is fastened to a glove of the equipment worn by the gun loader.

13. Equipment as claimed in claim 12, wherein the temperature sensor is fastened to another glove provided on the equipment worn by the gun loader.

* * * * *